US007159370B2

(12) United States Patent
Oliphant et al.

(10) Patent No.: US 7,159,370 B2
(45) Date of Patent: Jan. 9, 2007

(54) MODULAR FIBERGLASS REINFORCED POLYMER STRUCTURAL POLE SYSTEM

(75) Inventors: Zachary James Oliphant, Tomball, TX (US); Garett William Oliphant, Tomball, TX (US)

(73) Assignee: ReliaPOLE Solutions, Inc., Tomball, TX (US)

( * ) Notice: Subject to any disclaimer, the term of this patent is extended or adjusted under 35 U.S.C. 154(b) by 540 days.

(21) Appl. No.: 10/766,573

(22) Filed: Jan. 27, 2004

(65) Prior Publication Data

US 2005/0160697 A1 Jul. 28, 2005

(51) Int. Cl.
*E04C 3/30* (2006.01)

(52) U.S. Cl. ..... 52/731.4; 52/731.3; 52/732.3

(58) Field of Classification Search ..... 52/651.01, 52/651.07, 736.1, 726.3, 726.1, 737.6, 732.3, 52/732.2, 731.4, 731.3, 586.1, 586.2, 40; D25/126; 138/157, 162, 167; 446/111, 117, 446/122, 124

See application file for complete search history.

(56) References Cited

U.S. PATENT DOCUMENTS

| | | | | |
|---|---|---|---|---|
| 466,012 | A | 12/1891 | Seaman | |
| 999,267 | A | 8/1911 | Slick | |
| 1,967,490 | A * | 7/1934 | White | 405/14 |
| 2,317,634 | A * | 4/1943 | Olsen | 52/242 |
| 3,196,990 | A | 7/1965 | Handley | |
| 3,276,182 | A | 10/1966 | Handley | |
| 3,291,437 | A | 12/1966 | Bowden et al. | |
| 3,557,422 | A | 1/1971 | Pfaff, Jr. | |
| 3,571,991 | A | 3/1971 | Doocy et al. | |
| 3,893,269 | A * | 7/1975 | Nelsson et al. | 52/65 |
| 4,216,895 | A * | 8/1980 | Holmes | 228/178 |
| 4,312,162 | A | 1/1982 | Medney | |
| 4,689,930 | A * | 9/1987 | Menchetti | 52/277 |
| 5,285,613 | A | 2/1994 | Goldsworthy et al. | |
| 5,319,901 | A | 6/1994 | Goldsworthy et al. | |
| 5,617,692 | A | 4/1997 | Johnson et al. | |
| 5,644,888 | A | 7/1997 | Johnson | |
| 5,864,998 | A | 2/1999 | Loomer | |
| 6,032,432 | A * | 3/2000 | Patti | 52/732.1 |
| 6,094,881 | A | 8/2000 | Lockwood | |
| 6,286,281 | B1 | 9/2001 | Johnson | |

* cited by examiner

*Primary Examiner*—Naoko Slack
*Assistant Examiner*—Jessica Laux
(74) *Attorney, Agent, or Firm*—Crain, Caton & James, P.C.; James E. Hudson, III

(57) ABSTRACT

This invention is a modular pole assembly comprised of corner pieces and panel members. Panel members are slidably engaged to the corner pieces and are retained in a direction normal to the engagement direction by a track in each slot that nests within a groove in each panel member. Comer pieces may include multiple slots along each side, allowing for multiple layers of panel members along each side, thereby increasing strength and allowing an insulative and structural fill material to be added between panel member layers. The height of the modular pole may be increased by inserting splicing posts between consecutive, adjacent corner members and inserting splicing pieces between co-planar adjacent panel members. The modular nature of the pole assembly provides for simple packaging and shipment of the various components and easy assembly at or near the installation location.

20 Claims, 7 Drawing Sheets

MODULAR FIBERGLASS REINFORCED POLYMER STRUCTURAL POLE SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to poles and more specifically relates to poles formed from modular components made of a composite material.

2. Description of the Related Art

The electric utility distribution pole market is dominated by standard, treated wood poles furnished by hundreds of wood preserving plants located throughout the United States. While relatively inexpensive in initial cost, wood poles face several issues ranging from the chemical preservatives with which they are treated to the structural soundness of newer poles.

The wood treating industry comes under ever increasing attack from environmentalists and other public interest groups based on claims that the chemical preservatives used in the treatment of wood poles, which include a large quantity of pesticides, may cause public health problems.

New poles are often constructed from "new growth" forests, which consist primarily of fast-growing hybrid species of trees. Some claim that the faster growing species may not be as strong as trees that are cultivated over many years from virgin forests.

To address these issues, as well as to provide a more aesthetically-pleasing utility pole, poles have been developed from various metals and composites in a variety of structural assemblages.

Prior art utility poles include:

U.S. Pat. No. 466,012 issued to J. S. Seaman on Dec. 29, 1891, discloses a method for the manufacture of posts and poles utilizing welding as a joining process for the steel plates comprising the improved post and poles.

U.S. Pat. No. 999,267 issued to E. E. Slick on Aug. 1, 1911, discloses a method of making tapering metal poles. This invention eliminates the requirements of inner webbing and a nested section required for vertical strength. The invention does not utilize mechanical bolting or welding as a means of fastening. The invention utilizes rolled blanks forming interlocking edges running vertically such that the rolled sections may be assembled.

U.S. Pat. No. 3,196,990 issued to H. E. Handley on Jul. 27, 1965, discloses a tapered structural member and method of making same. This invention utilizes aluminum as the preferred material and incorporates welding as a method of fastening longitudinal peripheral portions.

U.S. Pat. No. 3,276,182 issued to H. E. Handley on Oct. 4, 1966, discloses a taper structural member constructed from sectional vertical members coupled by tongue and groove fits. Internal bolting prevents rotation about the long axis of the vertical member.

U.S. Pat. No. 3,291,437 issued to G. F. Bowden et al. on Dec. 13, 1966, discloses a flexible panel with abutting reaction shoulders under compression for use in a vertical load-bearing member.

U.S. Pat. No. 3,557,422 issued to H. C. Pfaff, Jr. on Jan. 26, 1971, discloses a method of forming a pole base structure consisting of slotted panels arranged in a geometrically stable pattern. Each panel consists of a crimped edge, which is designed to be inserted into the slotted portions of the panels.

U.S. Pat. No. 3,571,991 issued to Edward S. Doocy et al. on Mar. 23, 1971, discloses a tubular steel pole with pairs of sidebars and web members secured together by welds along the edges of the sidebars. Internal bracing exists at points where sidebars extend outward.

U.S. Pat. No. 4,312,162 issued to Jonas Medney on Jan. 26, 1982, discloses a reinforced fiberglass pole suited for use in electric transmission systems. The invention utilizes reinforcing regions consisting of composite material made from pre-stressed longitudinally disposed fibers.

U.S. Pat. No. 5,285,613 issued to W. Brandt Goldsworthy et al. on Feb. 15, 1994, discloses a pultruded joint system and tower structure including re-entrant slots which lock into place horizontal members used to support a vertical load.

U.S. Pat. No. 5,319,901 issued to Goldsworthy et al. on Jun. 14, 1994, discloses a technique for connecting a cross member brace between a column and another cross member. A dovetailed shoulder fit facilitates the interlocking connection.

U.S. Pat. No. 5,617,692 issued to Johnson et al. on Apr. 8, 1997, discloses composite structure made entirely from interlocking pultruded composite members. The interlocking members found in this invention are non vertical strengthening members locate to give the vertical structure rigidity.

U.S. Pat. No. 5,644,888 issued to David W. Johnson on Jul. 8, 1997, discloses a heavy construction system using composite members, which are interfit using a dovetailed shoulder fit with other composite members to form a rigid post and beam or beam and brace.

U.S. Pat. No. 5,864,998 issued to Weston R. Loomer on Feb. 2, 1999, discloses modular structure members disposed in adjacent co-acting positions so that a selected number of modules assembled together form a peripherally enclosed modular structural member.

U.S. Pat. No. 6,094,881 issued to William D. Lockwood on Aug. 1, 2000, discloses a modular fiberglass reinforced polymer pole system comprising at least two corner pieces, each corner piece having two ends, and having a continuous channel and further comprising at least two tapered panel pieces, each panel piece designed to be glued into the slot of corner piece when said panel piece is fully inserted into said corner slot.

U.S. Pat. No. 6,286,281 issued to David W. Johnson on Sep. 11, 2001, discloses a tubular tapered composite pole for supporting utility lines formed from elongated panels made of pultruded composite material. The elongated panels are trapezoidal in shape featuring a tongue and groove fit along its mating surface with the adjacent elongated panel. The panels interlock to form a closed loop giving the vertical pole rigidity.

It would be an improvement in the art to have a pole that meets utility pole structural standards and that does not require treatment with pesticides and other potentially harmful chemical preservatives.

It would further be an improvement in the art to have a modular configuration that simply and easily allows for additional reinforcement pursuant to calculated strength desired.

It would further be an improvement in the art to have a modular fiberglass reinforced polymer pole, the components of which are easily packaged and shipped, and that may be simply assembled on or near the installation site rather than as a final product.

It would further be an improvement in the art to have a modular pole in which the interface of the modular components provides additional strength to the pole.

BRIEF SUMMARY OF THE INVENTION

Accordingly, the objects of this invention is to provide, inter alia, a modular utility pole assembly that:

- does not require the use of pesticides and chemical preservatives;
- has a modular structure that allows for additional reinforcements, as desired for calculated strength;
- the modular components are easily packaged and shipped;
- has few components to assemble;
- can be assembled on or near the installation site; and
- meets the structural requirements for utility poles.

Other features and advantages of the invention will be apparent from the following description, the accompanying drawing and the appended claims.

This invention is a modular pole assembly comprised of corner pieces and panel members. Panel members are slidably engaged to the corner pieces and are retained in a direction normal to the engagement direction by a track in each slot that nests within a groove in each panel member. Corner pieces may include multiple slots along each side, allowing for multiple layers of panel members along each side, thereby increasing strength and allowing an insulative and structural fill material to be added between panel member layers. The height of the modular pole may be increased by inserting splicing posts between consecutive adjacent corner members and inserting splicing pieces between co-planar adjacent panel members.

DESCRIPTION OF THE INVENTION

Figure 1:
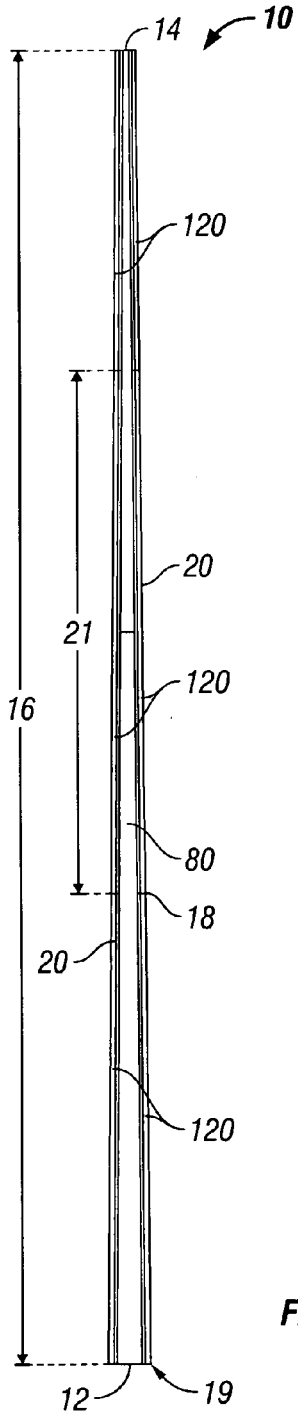
FIG. 1 is a side view of assembled modular pole.
Figure 5:
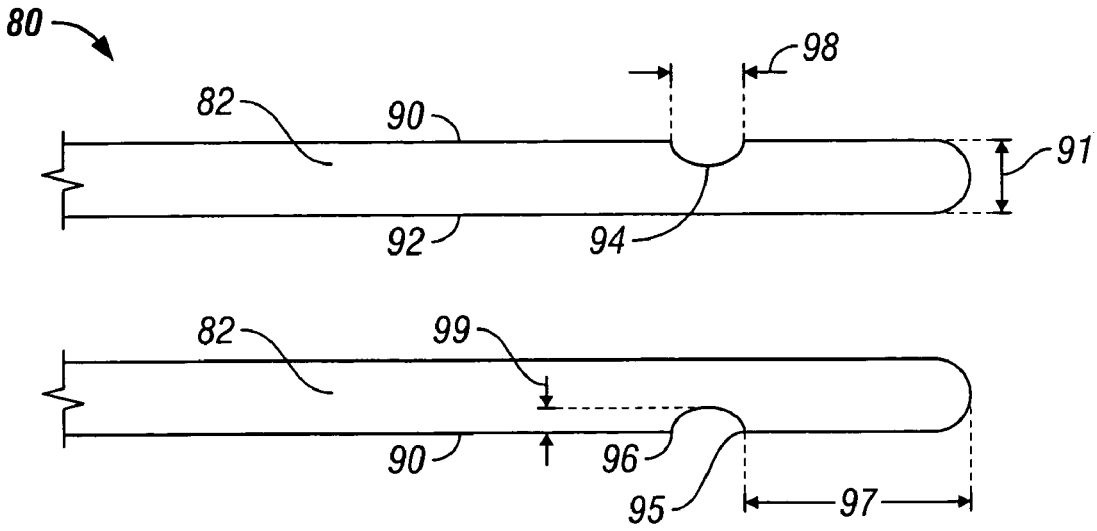
FIG. 5 is a cross sectional view of a side.

Referring to FIG. 1, the inventive assembled modular pole 10 is depicted. The modular pole comprises a plurality of corner pieces 20 and a plurality of sides 80. Each side 80 includes at least two panel members 82, as shown in FIG. 5, arranged in parallel, and slidably engaged to corner pieces 20. Modular pole 10 has a pole height 16, defined as the distance between a pole base 12 and a pole top 14.

Figure 2:
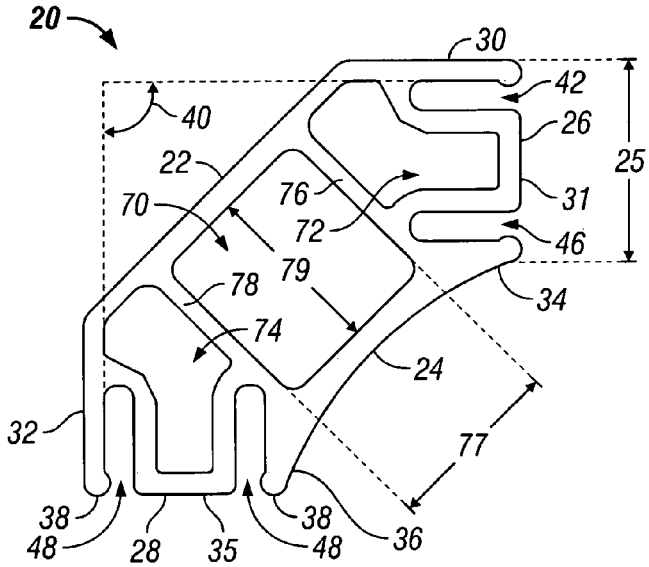
FIG. 2 is a cross sectional view of a corner piece.
Figure 3:
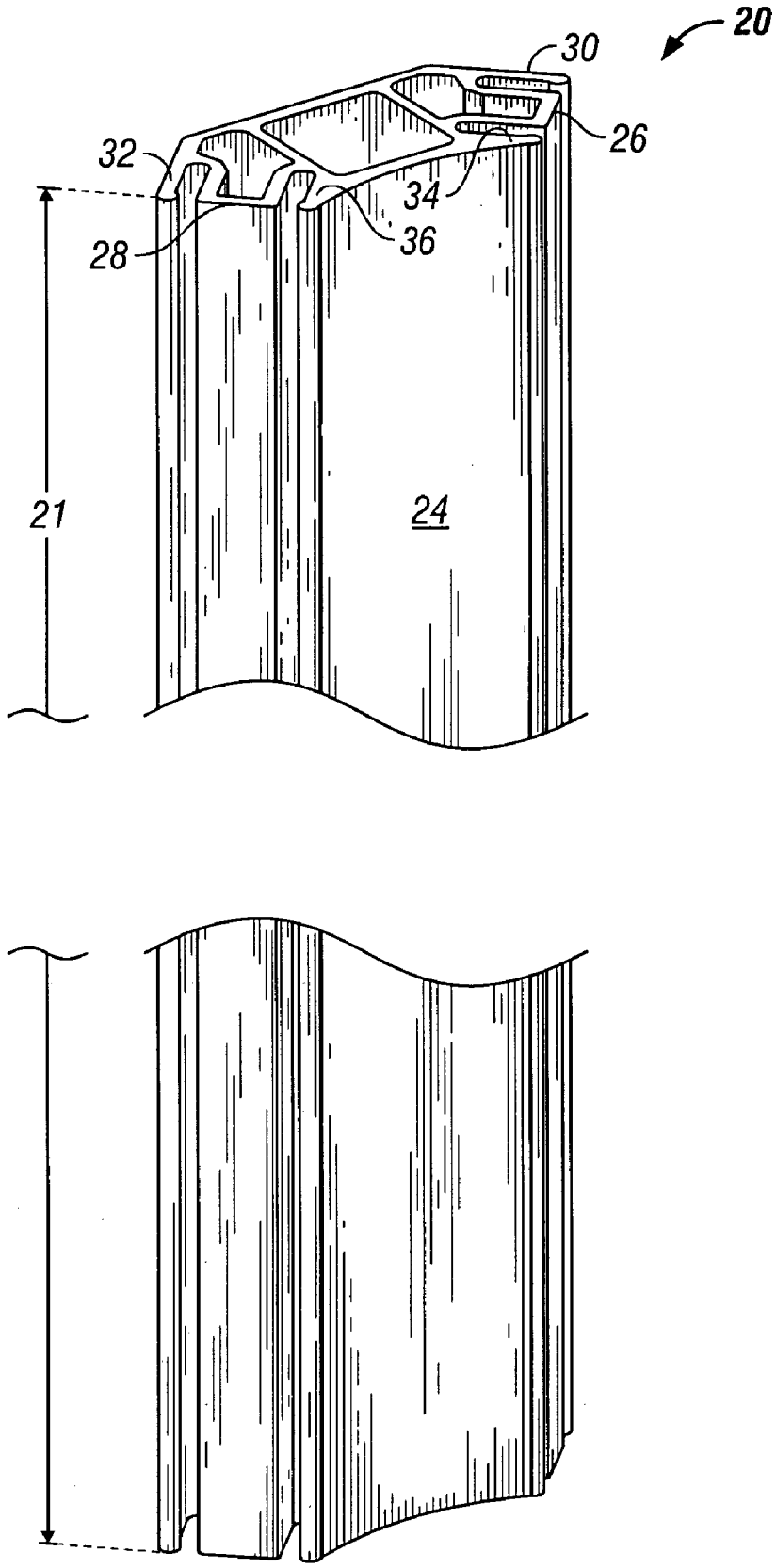
FIG. 3 is perspective view of a corner piece.

Referring to FIGS. 2 and 3, corner piece 20 is depicted. Each corner piece 20 has a corner length 21, which may be less than or equal to pole height 16. Corner splicing posts 100, described in greater detail below, may adjoin adjacent corner pieces 20 when a pole height 16 greater than corner length 21 is desired.

Each corner piece 20 has a cross sectional geometry defined by an outer corner surface 22, an inner corner surface 24, a first end 26 and a second end 28. Outer corner surface 22 and inner corner surface 24 are separated by a corner width 25. First end 26 and second end 28 are intermediate outer corner surface 22 and inner corner surface 24 along opposing ends of corner piece 20.

First end 26 includes a first center support 31 intermediate a first inner finger 34 and a first outer finger 30, while second end 28 includes a second center support 35 intermediate a second inner finger 36 and a second outer finger 32. A gap between first outer finger 30 and first center support 31 defines a first outer receiving slot 42. A first inner receiving slot 46 is defined by a gap between first center support 31 and first inner finger 34. Along second end 28, a second outer receiving slot 44 is defined by a gap between second center support 35 and second outer finger 32 and a second inner receiving slot 48 is defined by a gap between second center support 35 and second inner finger 36.

In an alternate embodiment, first and second ends 26, 28 each include a plurality of inner fingers (not shown) defining additional slots (not shown) therebetween.

Figure 7:
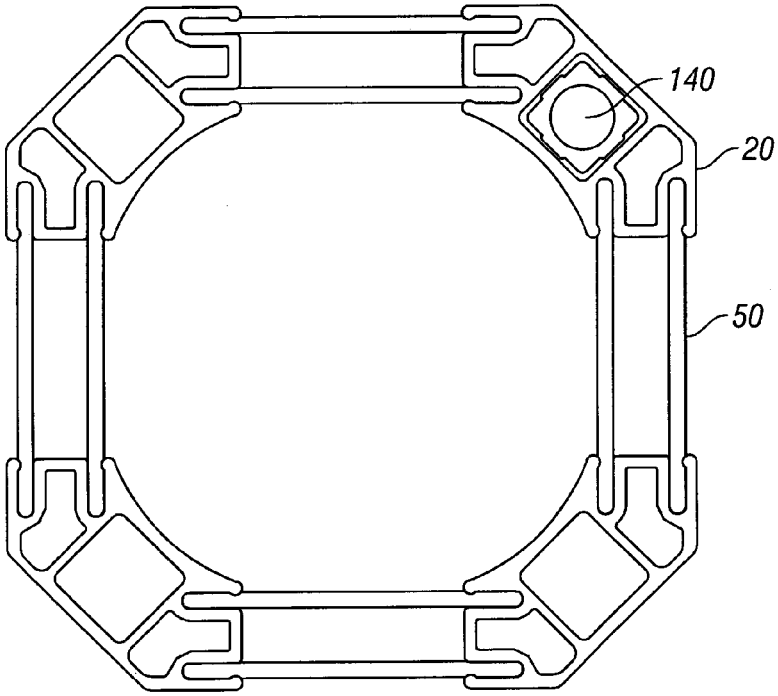
FIG. 7 is an assembled modular pole proximate the base of the pole.
Figure 8:
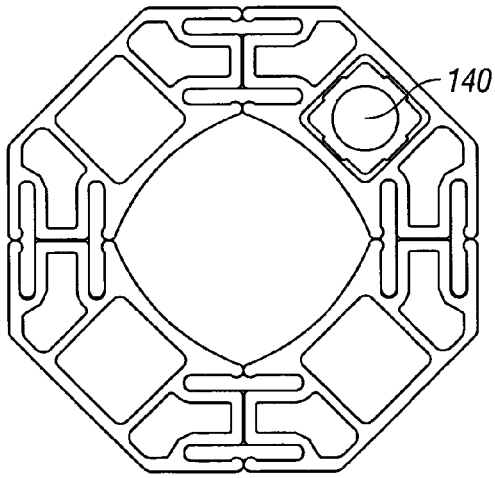
FIG. 8 is an assembled modular pole proximate the top of the pole.

First outer receiving slot 42 is parallel with first inner receiving slot 46 and second outer receiver slot 44 is parallel with second inner receiving slot 48. First inner and outer receiving slots 42, 46 are at a corner angle 40 relative to second inner and outer receiving slots 44, 48. Corner angle 40 is less than 180°, with the dimension being defined by the number of sides 80 of modular pole 10. The value of corner angle 40 is dependent upon the predetermined number of sides modular pole 10 is to have. For example, corner angle 40 will range from 0° for a two-sided pole (not shown) to 60° for a three-sided pole (not shown) to 135° for an eight-sided pole (not shown). A four-sided modular pole 10 is depicted in FIGS. 1, 7 and 8, having a corner angle 40 that is 90°. Modular pole 10 may have any number of sides with the value of corner angle 40 being defined by the equation:

$$\text{Corner angle } 40 = 180° - (360°/(\text{number of sides})).$$

The value of corner angle 40 may be slightly different due to various causes, including minor twisting corner pieces 20 during the formation of such pieces.

Figure 4:
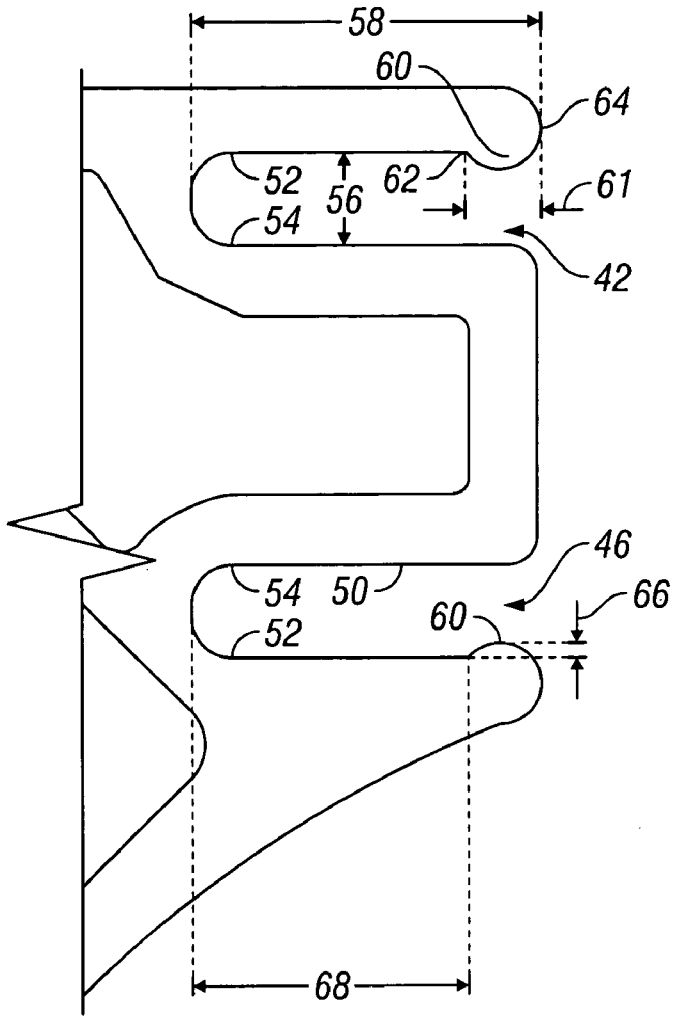
FIG. 4 is a cross sectional view of receiving slot detail.

As shown in FIG. 4, receiving slots 42, 44, 46, 48 have U-shaped slot surfaces 50 defined by finger wall 52 and side wall 54, separated by a slot width 56. Each receiving slot 42, 44, 46, 48 has a slot depth 58.

A track 60 protrudes from each finger wall 52 of slot surface 50 and extends towards side wall 54 along the entire distance of corner length 21. Track 50 has a track width 61, which is the width of the protuberance of track 60 along finger wall 52 between an inner track side 62 and an outer track side 64. Track 60 also has a track depth 66, which is the distance track 60 extends from finger wall 52 toward side wall 54. Track 60 may have an arcuate cross sectional shape. The location of track 60 may be along finger wall 52 such that outer track side 64 abuts a finger end 38. Alternatively, a finger extension (not shown) may separate outer track 64 from finger end 38. The distance from inner track side 62 to a point on slot surface 50 farthest from finger end 38 defines slot location 68.

Corner piece 20 may include at least one channel 70 along corner length 21. Additional side channels 72 and 74 may also be formed in corner piece 20 by including channel walls 76, 78 within channel 70. Channel 70 and side channels 72, 74 may be filled with a type of foam (not shown) such as polyurethane closed cell foam to increase rigidity of modular pole 10 and to provide an improved basic insulation level. Alternatively, or in addition to the foam fill, wiring 140 (shown in FIGS. 7 and 8) may be threaded through channel 70 and/or additional channels 72, 74. Channel 40 has a channel width 77 and a channel depth 79.

Figure 6:
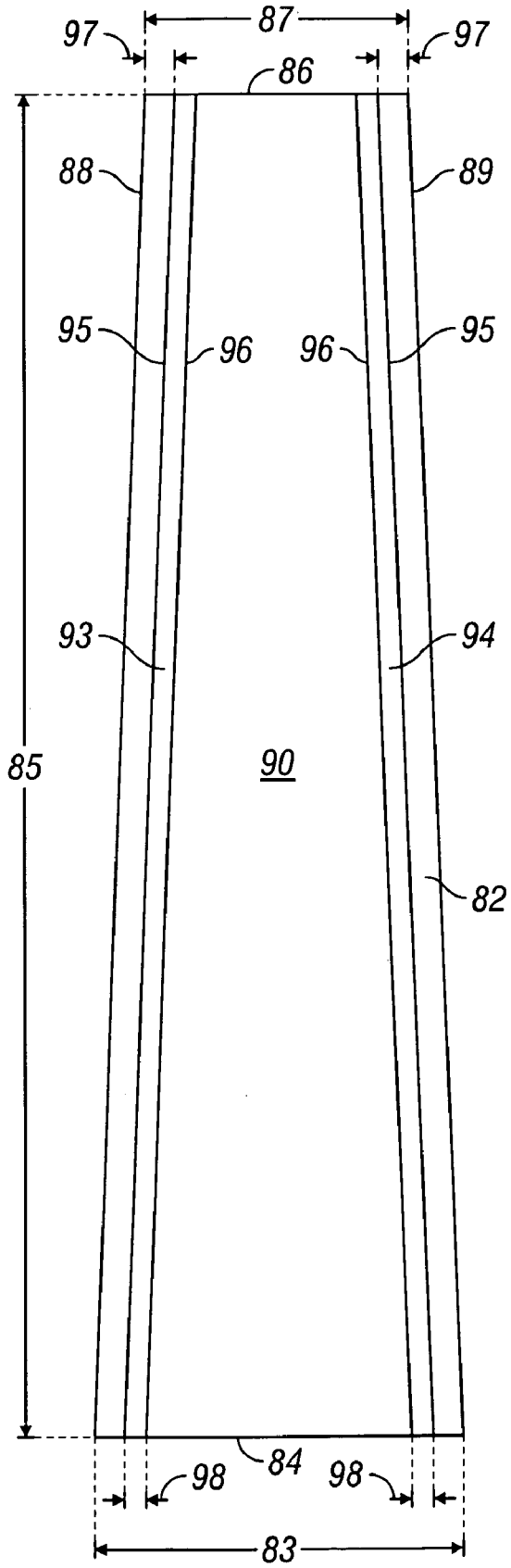
FIG. 6 is a front view of a panel member.

FIGS. 5 and 6 depict modular panel members 82. Panel members 82 may have a panel length 85 that is equal to or less than the length of pole height 16. Panel splicing pieces 110, described below, may adjoin co-planar, consecutive panel members 82 when a pole height 16 that is greater than panel length 85 is desired.

Panel members 82 include a base edge 84 having a base width 83 and a top edge 86 having a top width 87. Panel members 82 also include a first long edge 88 and a second long edge 89 intermediate base edge 84 and top edge 86. Panel members 82 may be tapered in shape having base width 83 greater than top width 87, thereby providing increased robustness to the assembled pole 10. Base edge 84, first long edge 88, top edge 86, and second long edge 89 border a grooved surface 90 and a flat surface 92 of each panel member 82. The distance between grooved surface 90 and flat surface 92 is a panel thickness 91.

A first and second groove 93 and 94 are formed in grooved surface 90 of each panel member 82 along panel length 85. First and second grooves 93, 94 are each bounded by an outer groove edge 95, which is closest first or second long edge 88 or 89, respectively, and an inner groove edge 96, which is farthest from first or second long edge 88 or 89, respectively. The distance between outer groove edge 95 and inner groove edge 96 of each of first and second groove 93 and 94 is a groove width 98. The depth of each groove 93, 94 into panel member 82 from grooved surface 90 is a groove depth 99. First and second grooves 93 and 94 may have an arc-shaped profile to match the profile of track 60. First groove 93 extends along panel length 85 parallel to first long edge 88. Second groove 94 extends along panel length 85 in a direction parallel to second long edge 89. The distance from first long edge 88 or second long edge 89 to outer groove edge 95 defines a groove location 97.

Groove width 98 is sized to accommodate track width 61 and groove depth 99 is sized to accommodate track depth 66, so that track 60 nests within first or second groove 93 or 94. Slot depth 58 and groove location 97 are sized to align first and second grooves 93, 94 with their respective tracks 60. Slot width 56 is wide enough to accept panel thickness 91. Thus, panel members 82 are retained along first and second long edges 88 and 89 by receiving slots 42, 44, 46, and 48 in corner piece 20 with track 60 fitting within first or second groove 93 or 94.

The plurality of panel members 82 of sides 80 increases the structural strength of modular pole 10. A foam fill (not shown) such as polyurethane closed cell foam, may be added between panel members 82 on each side for additional rigidity and insulation.

Figure 9:
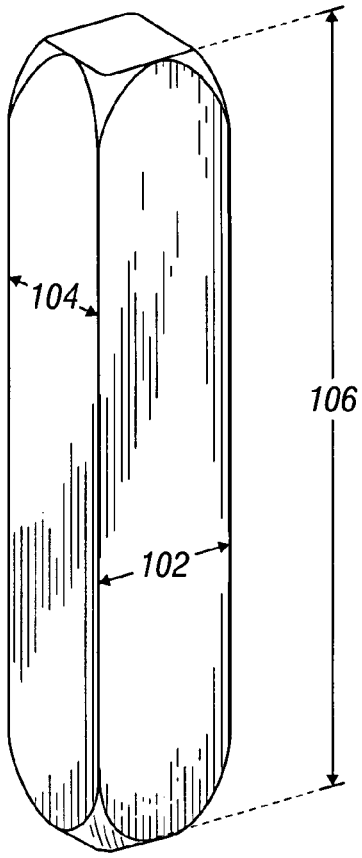
FIG. 9 is a corner splicing post.
Figure 10:
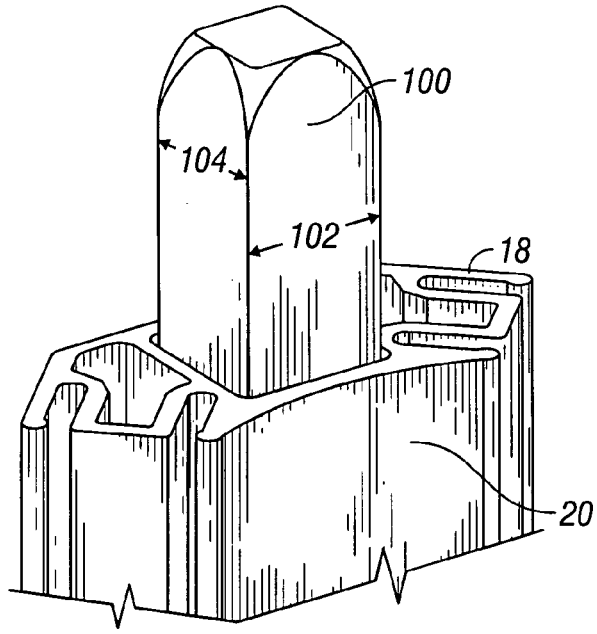
FIG. 10 is a corner splicing post in a corner piece.

Referring to FIGS. 9 and 10, a corner splicing post 100 is depicted. Corner splicing posts 100 are used to adjoin consecutive corner pieces 20 until the sum of the corner lengths 21 of consecutive corner pieces 20 equals pole height 16. Corner pieces 20 may be subdivided into corner piece sets 120, depicted in FIG. 1. Each corner piece set 120 is adjoined with panel members 82 to form a tubular structure that makes up a segment of the entire modular pole 10. To adjoin two adjacent corner piece sets 120, corner splicing posts 100 are placed into channel 70 of each corner piece 20 in the lowest corner piece set 120 at what is or will be an upper end 18 of the corner pieces 20 of the lower corner piece set 19. Each corner splicing post 100 has a post width 102 and a post depth 104. Post width 102 and post depth 104 are sized to provide an interference fit with channel width 77 and channel depth 79. Post width 102 and post depth 104 may be slightly smaller at each end of corner splicing post 100 to facilitate insertion into channel 70 of corner pieces 20 being adjoined. Corner splicing post 100 also has a post length 106. When inserted into channel 70 of a corner piece 20, approximately half of post length 106 is held within channel 70. Channel 70 of a lower end 19 of corner pieces 20 in an adjacent corner piece set 120 are then placed over the free end of corner splicing posts 100. The size of post length 106 of corner splicing post 100 is determined by the length of corner splicing post 100 to be held within channel 70 of each of the consecutive, adjacent corner pieces 20. Upper end 18 of one corner piece set 120 abuts lower end 19 of another corner piece set 120 when properly adjoined by corner splicing posts 100.

Figure 11:
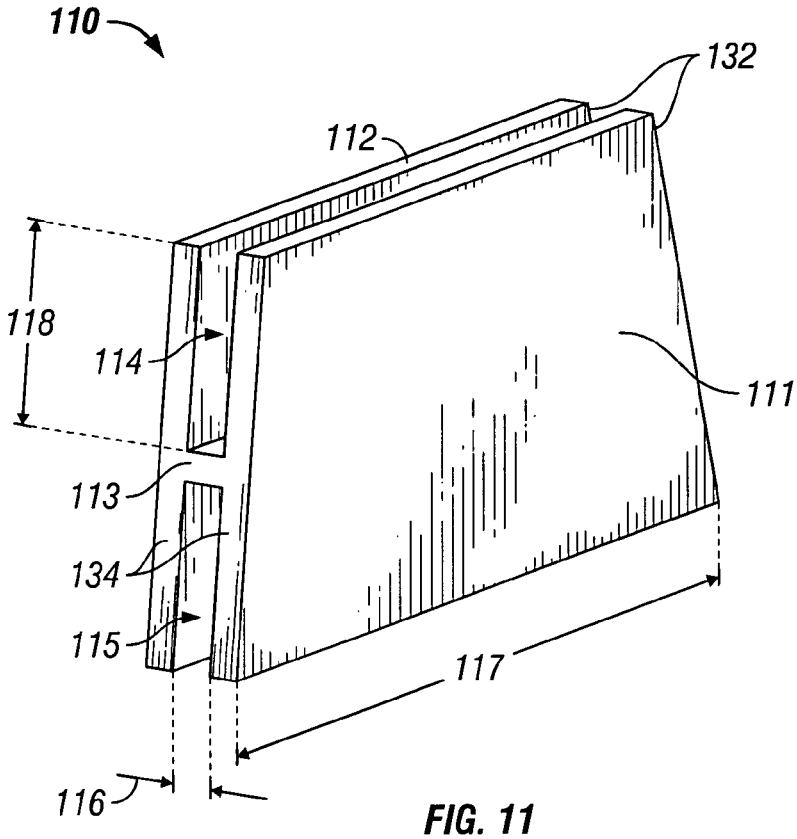
FIG. 11 is a panel splicing piece.
Figure 12:
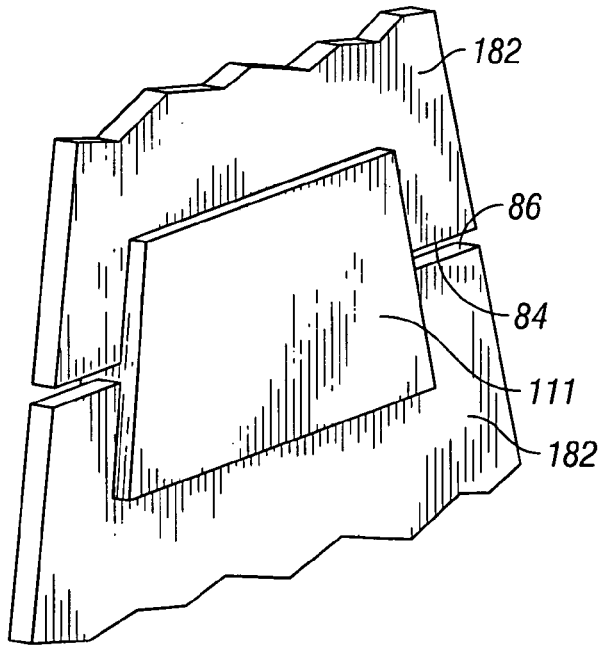
FIG. 12 is a panel splicing piece between two adjacent panel members.
Figure 1:
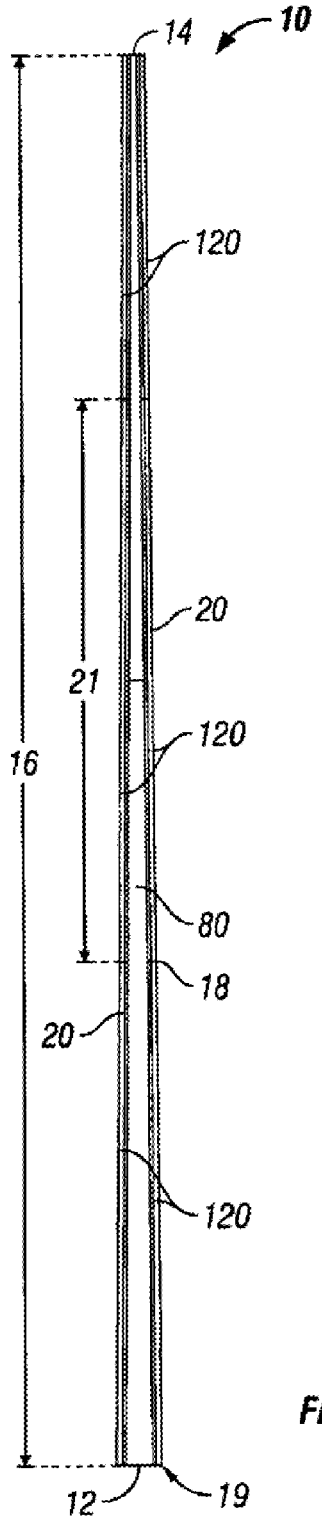
Figure 2:
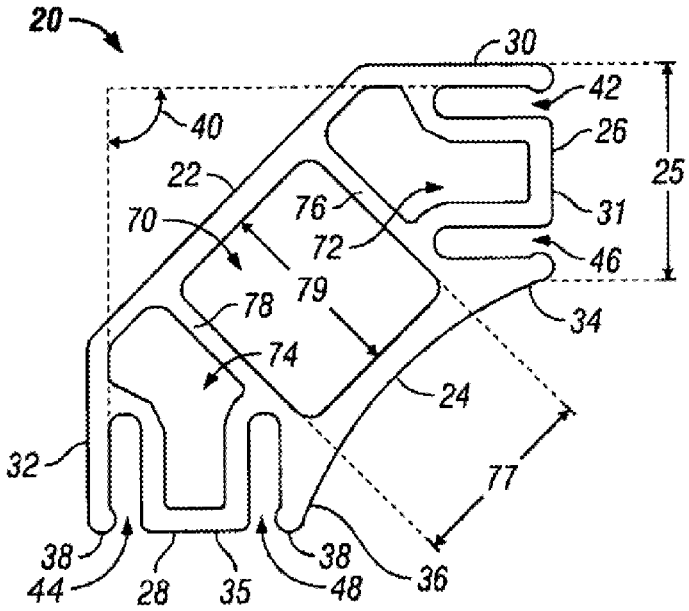
Figure 7:
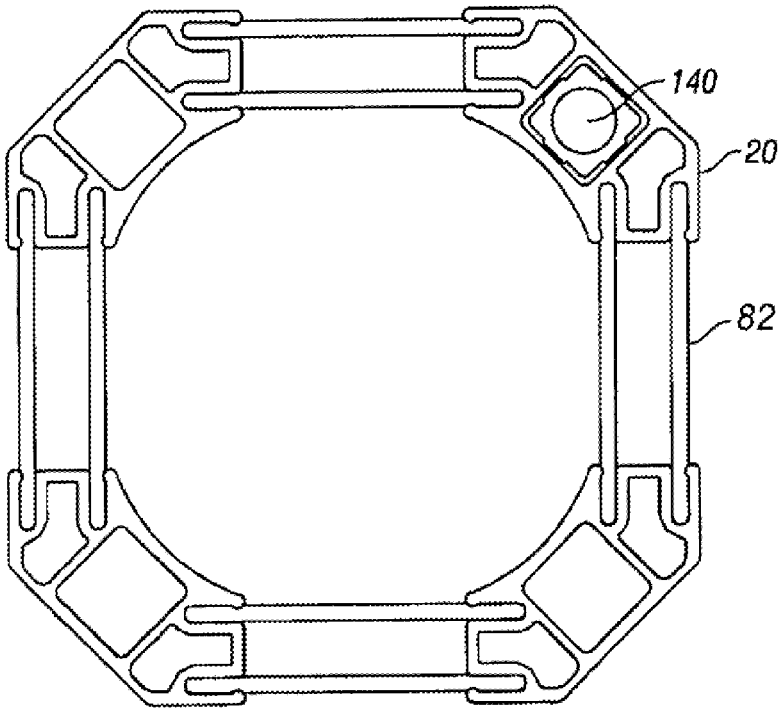
Figure 8:
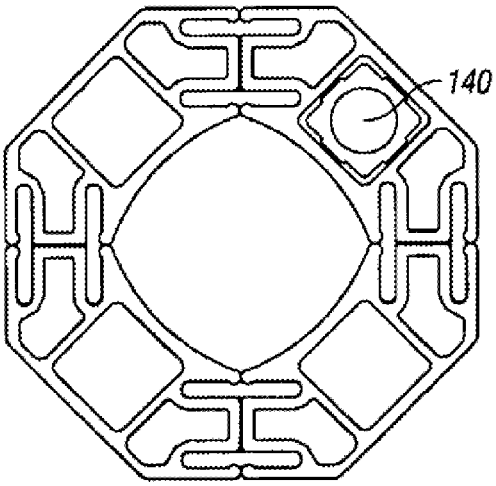

Referring to FIGS. 11 and 12, panel splicing pieces 110 may adjoin co-planar panel members 82 until the sum of panel lengths 85 of consecutively adjoined panel members 82 equals pole height 16. Panel members 82 may be subdivided into panel sets 182. Each panel set 182 is used with a corner piece set 120 to form a tubular structure that makes up a segment of the entire modular pole 10. Panel splicing pieces 110 are H-shaped, comprising two parallel plates 111 and 112 adjoined by a center member 113 to form two splicing slots 114 and 115. The splicing slot width 116 between parallel plates 111 and 112 is sufficient to snugly receive panel thickness 91 of top edge 86 of the panel members 82 of the lower panel set 182 and panel thickness 91 of base edge 84 of the panel members 82 of the upper panel set 182. Panel splicing pieces 110 have a splice piece width 117 sufficient to fit between corner pieces 20 with which adjoined co-planar panel members 82 engage. Parallel plates 111 and 112 may have slightly tapered outer edges 132 and 134 to correspond to the taper of adjoining panel members 82, making the splice piece width 117 wider proximate top edge 86 of the lower panel members 82 than proximate bottom edge 83 of upper panel members 82. Center member 113 of panel splicing pieces 100 has a center depth 118. The size of center depth 118 of each panel splicing piece 110 is considered with panel length 85 of each panel member 82 along a side 80 to determine pole height 16.

Panel members 82 and corner pieces 20 may be made from a polymer with fiberglass reinforcement. Other possible materials include other fiberglass composites, other plastics, metals, and wood. Corner pieces 20 made from fiberglass composites, other plastics, or metals may be extruded.

To assemble a modular pole 10, first long edge 87 of one panel member 82 is slidingly inserted into first outer receiving slot 42 of a first corner piece 20 and second long edge 88 is slidingly inserted into second outer receiving slot 44 of a second corner piece 20. Another panel member 82 is slidingly inserted into between the same two corner pieces 20, with first long edge 87 inserted into first inner receiving slot 46 of the first corner piece 20 and second long edge 88 inserted into second inner receiving slot 48 of the second corner piece 20.

The first long edge 87 of two additional panels members 82 are inserted into first inner and first outer receiving slots 42 and 46 of the second corner piece 20. Second long edge 88 of the additional panels 82 are inserted into second inner and second outer receiving slots 44 and 48 of a third corner piece 20. This process is continued until two panel members 82 are inserted between corner pieces 20 such that the modular pole 10 has the number of sides 80 that was previously determined.

There are some alternative embodiments to modular pole 10. If a pole height 16 is desired that is greater than the length of panel members 82 and corner pieces 20, panel splicing pieces 110 and corner splicing posts 100 are used as previously described. First end 26 and second end 28 may be formed with additional receiving slots (not shown) therein, thus permitting additional panel members 82 to be inserted between corner pieces 20. Insulation or other material may be used to fill the space created within modular pole 10 bounded by panel members 82 retained by first and second inner retaining slots 46, 48.

Assembled modular poles 10 may be utilized to hold various types of electrical equipment, electrical wires, wireless communications equipment, lighting fixtures, traffic equipment or signs.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

What is claimed is:

1. A modular pole assembly comprising:

a plurality of sides;

each of said plurality of sides including at least two panel members;

each of said at least two panel members of each of said plurality of sides having a first long edge and a second long edge;

a plurality of corner pieces in matching quantity to said plurality of sides;

said plurality of corner pieces each including a first end and a second end;

said first long edge of each of said at least two panel members of each of said sides being retained along said first end of each of said plurality of corner pieces adjacent said first long edge of each of said at least two panel members of each of said sides;

said second long edge of each of said at least two panel members of each of said sides being retained along said second end of each of said plurality of corner pieces adjacent said second long edge of each of said at least two panel members of each of said sides;

said plurality of sides and said plurality of corner pieces attached such that a tubular structure is defined;

said first end of each of said plurality of corner pieces including a first inner finger, a first center support and a first outer finger;

said first long edge of one of said at least two panel members of each of said sides held within a first inner receiving slot intermediate said first inner finger and said first center support;

said first long edge of a second of said at least two panel members of each of said sides held within a first outer receiving slot intermediate said first outer finger and said first center support;

said second end of each of said plurality of corner pieces including a second inner finger, a second center support and a second outer finger;

said second long edge of one of said at least two panel members of each of said sides held within a second inner receiving slot intermediate said second inner finger and said second center support;

said second long edge of said second of said at least two panel members of each of said sides held within a second outer receiving slot intermediate said second outer finger and said second center support.

2. The modular pole assembly of claim 1, further comprising:

said at least two panel members of said plurality of sides each including a grooved surface;

a first groove in said grooved surface parallel to said first long edge of each of said at least two panel members of said plurality of sides;

a second groove in said grooved surface parallel to said second long edge of each of said at least two panel members of said plurality of sides;

a first inner track within said first inner receiving slot along said first end of each of said plurality of corner pieces;

a first outer track within said first outer receiving slot along said first end of each of said plurality of corner piece;

said first inner track nested within said first groove of a first panel member of said at least two panel members of each of said sides;

said first outer track nested within said first groove of a second panel member of said at least two panel members of each of said sides;

a second inner track within said second inner receiving slot along said second end of each of said plurality of corner pieces;

a second outer track within said second outer receiving slot along said second end of each of said plurality of corner pieces;

said second inner track nested within said second groove of said first panel member of said at least two panel members of each of said sides;

said second outer track nested within said second groove of said second panel member of said at least two panel members of each of said sides.

3. The modular pole assembly of claim 2, further comprising:

said first inner track extending from said first inner finger toward said first center support;

said first outer track extending from said first outer finger toward said first center support;

said second inner track extending from said second inner finger toward said second center support;

said second outer track extending from said second outer finger toward said second center support;

said first inner track, said first outer track, said second inner track and said second outer track each having an outwardly curved profile;

said first groove and said second groove each having an inwardly curved profile; said outwardly curved profile fitting within said inwardly curved profile.

4. The modular pole assembly of claim 1, further comprising:

said plurality of corner pieces each including an outer corner surface and an inner corner surface;

said plurality of corner pieces each having a corner length;

said plurality of corner pieces each having at least one channel extending therethrough along said corner length;

said at least one channel of each of said plurality of corner pieces located between said outer corner surface and said inner corner surface.

5. The pole assembly of claim 4 further comprising:

at least one wire extending through said at least one channel of at least one of said plurality of corner pieces;

said wire providing electrical continuity between at least two points on said tubular structure.

6. The modular pole assembly of claim 4, further comprising:

an insulative foam filling at least one channel of at least one of said plurality of corner pieces.

7. The pole assembly of claim 4, further comprising:

at least one wire extending through said at least one channel of at least one of said plurality of corner pieces;

said wire providing electrical continuity between at least two points on said tubular structure;

insulation filling said at least one channel of each of said plurality of corner pieces not having wire extending therethrough.

8. The modular pole assembly of claim 4, further comprising:

a pole height;

said corner length being less than said pole height;

said plurality of corner pieces each having an upper end and a lower end;

said plurality of corner pieces divided into a plurality of corner piece sets;

a plurality of corner splicing posts; said plurality of corner splicing posts each having an upper post end and a lower post end;

said at least one channel in said upper end of said plurality of corner pieces of at least one of said plurality of corner piece sets each receiving said lower post end of said plurality of splicing posts in an interference fit such that said upper post end of said plurality of splicing posts is held within said channel and extends from said upper end of said plurality of corner pieces of said at least one of said plurality of corner piece sets;

said at least one channel in said lower end of said plurality of corner pieces of at least one of said plurality of corner piece sets each receiving said upper post end of said plurality of splicing posts in an interference fit such that said upper post end is held within said channel and said lower end and said upper end of consecutive, adjacent corner pieces of said plurality of corner piece sets are in abutment;

said plurality of splicing posts adjoining said plurality of corner piece sets such that said corner length of each of said consecutive adjacent corner pieces sums said pole height.

9. The modular pole assembly of claim 4, further comprising:

said plurality of sides each having a panel height;

said panel height being less than said pole height;

said at least two panel members of said plurality of sides each having a base edge and a top edge;

said plurality of sides divided into a plurality of panel sets;

a plurality of panel splicing pieces each including two parallel plates adjoined by a center member such that a first splicing slot and a second splicing slot are formed;

said first splicing slot of each of said plurality of panel splicing pieces receiving said top edge of each of said at least two panel members of at least one of said plurality of panel sets;

said second splicing slot of each of said plurality of panel splicing pieces receiving said base edge of each of said at least two panel members of at least one of said plurality of panel sets such that two panel members are held in co-planar alignment;

said plurality of panel splicing pieces adjoining said plurality of panel sets such that said panel height of each of said panel members held in co-planar alignment sums said pole height.

10. The modular pole assembly of claim 9, further comprising:

said corner length being less than said pole height;

said plurality of corner pieces each having an upper end and a lower end;

said plurality of corner pieces divided into a plurality of corner piece sets;

a plurality of corner splicing posts;

said plurality of corner splicing posts each having an upper post end and a lower post end;

said at least one channel in said upper end of said plurality of corner pieces of at least one of said plurality of corner piece sets each receiving said lower post end of said plurality of splicing posts in an interference fit such that said upper post end of said plurality of splicing posts is held within said channel and extends from said upper end of said plurality of corner pieces of said at least one of said plurality of corner piece sets;

said at least one channel in said lower end of said plurality of corner pieces of at least one of said plurality of corner piece sets each receiving said upper post end of said plurality of splicing posts in an interference fit such that said upper post end is held within said channel and said lower end and said upper end of consecutive, adjacent corner pieces of said plurality of corner piece sets are in abutment;

said plurality of splicing posts adjoining said plurality of corner piece sets such that said corner length of each of said consecutive, adjacent corner pieces sums said pole height.

11. The modular pole assembly of claim 1, further comprising:

insulation intermediate each of said at least two panel members of each of said sides.

12. The modular pole assembly of claim 1, further comprising:

said first end of each of said plurality of corner pieces including a plurality of first end fingers;

said first long edge of said at least two panel members held each within one of a plurality receiving slots defined between each of said plurality of first end fingers;

said second end of each of said plurality of corner pieces including a plurality of second end fingers;

said second long edge of said at least two panel members held within one of a plurality of receiving slots defined between each of said plurality of second end fingers.

13. A modular pole assembly comprising:

a plurality of sides;

each of said plurality of sides including at least two panel members;

each of said at least two panel members of each of said plurality of sides having a first long edge and a second long edge;

a plurality of corner pieces in matching quantity to said plurality of sides;

said plurality of corner pieces each including a first end and a second end;

said first long edge of each of said at least two panel members of each of said sides being retained along said first end of each of said plurality of corner pieces adjacent said first long edge of each of said at least two panel members of each of said sides;

said second long edge of each of said at least two panel members of each of said sides being retained along said second end of each of said plurality of corner pieces adjacent said second long edge of each of said at least two panel members of each of said sides;

said plurality of sides and said plurality of corner pieces attached such that a tubular structure is defined;

said first end of each of said plurality of corner pieces including a first inner finger, a first center support and a first outer finger;

said first long edge of one of said at least two panel members of each of said sides held within a first inner receiving slot intermediate said first inner finger and said first center support;

said first long edge of a second of said at least two panel members of each of said sides held within a first outer receiving slot intermediate said first outer finger and said first center support;

said second end of each of said plurality of corner pieces including a second inner finger, a second center support and a second outer finger;

said second long edge of one of said at least two panel members of each of said sides held within a second inner receiving slot intermediate said second inner finger and said second center support;

said second long edge of said second of said at least two panel members of each of said sides held within a second outer receiving slot intermediate said second outer finger and said second center support;

said at least two panel members of said plurality of sides each including a grooved surface;

a first groove in said grooved surface parallel to said first long edge of each of said at least two panel members of said plurality of sides;

a second groove in said grooved surface parallel to said second long edge of each of said at least two panel members of said plurality of sides;

a first inner track within said first inner receiving slot along said first end of each of said plurality of corner pieces;

a first outer track within said first outer receiving slot along said first end of each of said plurality of corner piece;

said first inner track nested within said first groove of a first panel member of said at least two panel members of each of said sides;

said first outer track nested within said first groove of a second panel member of said at least two panel members of each of said sides;

a second inner track within said second inner receiving slot along said second end of each of said plurality of corner pieces;

a second outer track within said second outer receiving slot along said second end of each of said plurality of corner pieces;

said second inner track nested within said second groove of said first panel member of said at least two panel members of each of said sides;

said second outer track nested within said second groove of said second panel member of said at least two panel members of each of said sides;

said plurality of corner pieces each including an outer corner surface and an inner corner surface;

said plurality of corner pieces each having a corner length;

said plurality of corner pieces each having at least one channel extending therethrough along said corner length;

said at least one channel of each of said plurality of corner pieces located between said outer corner surface and said inner corner surface.

14. The modular pole assembly of claim 13, further comprising:

said first inner track extending from said first inner finger toward said first center support;

said first outer track extending from said first outer finger toward said first center support;

said second inner track extending from said second inner finger toward said second center support;

said second outer track extending from said second outer finger toward said second center support;

said first inner track, said first outer track, said second inner track and said second outer track each having an outwardly curved profile;

said first groove and said second groove each having an inwardly curved profile;

said outwardly curved profile fitting within said inwardly curved profile.

15. The modular pole assembly of claim 13, further comprising:

at least one wire extending through said at least one channel of at least one of said plurality of corner pieces;

said wire providing electrical continuity between at least two points on said tubular structure;

insulation filling said at least one channel of each of said plurality of corner pieces not having wire extending therethrough.

16. The modular pole assembly of claim 13, further comprising:

insulation intermediate each of said at least two panel members of each of said sides.

17. The modular pole assembly of claim 16, further comprising:

at least one wire extending through said at least one channel of at least one of said plurality of corner pieces;

said wire providing electrical continuity between at least two points on said tubular structure;

insulation filling said at least one channel of each of said plurality of corner pieces not having wire extending therethrough.

18. The modular pole assembly of claim 17, further comprising:

said corner length being less than said pole height;

said plurality of corner pieces each having an upper end and a lower end;

said plurality of corner pieces divided into a plurality of corner piece sets;

a plurality of corner splicing posts;

said plurality of corner splicing posts each having an upper post end and a lower post end;

said at least one channel in said upper end of said plurality of corner pieces of at least one of said plurality of corner piece sets each receiving said lower post end of said plurality of splicing posts in an interference fit such that said upper post end of said plurality of splicing posts is held within said channel and extends from said upper end of said plurality of corner pieces of said at least one of said plurality of corner piece sets;

said at least one channel in said lower end of said plurality of corner pieces of at least one of said plurality of corner piece sets each receiving said upper post end of said plurality of splicing posts in an interference fit such that said upper post end is held within said channel and said lower end and said upper end of consecutive, adjacent corner pieces of said plurality of corner piece sets are in abutment;

said plurality of splicing posts adjoining said plurality of corner piece sets such that said corner length of each of said consecutive, adjacent corner pieces sums said pole height.

19. The modular pole assembly of claim 13, further comprising:

a pole height;

said corner length being less than said pole height;

said plurality of corner pieces each having an upper end and a lower end;

said plurality of corner pieces divided into a plurality of corner piece sets;

a plurality of corner splicing posts;

said plurality of corner splicing posts each having an upper post end and a lower post end;

said at least one channel in said upper end of said plurality of corner pieces of at least one of said plurality of corner piece sets each receiving said lower post end of said plurality of splicing posts in an interference fit such that said upper post end of said plurality of splicing posts is held within said channel and extends from said upper end of said plurality of corner pieces of said at least one of said plurality of corner piece sets;

said at least one channel in said lower end of said plurality of corner pieces of at least one of said plurality of corner piece sets each receiving said upper post end of said plurality of splicing posts in an interference fit such that said upper post end is held within said channel and said lower end and said upper end of consecutive adjacent corner pieces of said plurality of corner piece sets we in abutment;

said plurality of splicing posts adjoining said plurality of corner piece sets such that said corner length of each of said consecutive, adjacent corner pieces sums said pole height.

20. The modular pole assembly of claim 13, further comprising:

said plurality of sides each having a panel height;

said panel height being less than said pole height;

said at least two panel members of said plurality of sides each having a base edge and a top edge;

said plurality of sides divided into a plurality of panel sets;

a plurality of panel splicing pieces each including two parallel plates adjoined by a center member such that a first splicing slot and a second splicing slot are formed;

said first splicing slot of each of said plurality of panel splicing pieces receiving said top edge of each of said at least two panel members of at least one of said plurality of panel sets;

said second splicing slot of each of said plurality of panel splicing pieces receiving said base edge of each of said at least two panel members of at least one of said plurality of panel sets such that two panel members are held in co-planar alignment;

said plurality of panel splicing pieces adjoining said plurality of panel sets such that said panel height of each of said panel members held in co-planar alignment sums said pole height.

* * * * *

UNITED STATES PATENT AND TRADEMARK OFFICE

CERTIFICATE OF CORRECTION

PATENT NO. : 7,159,370 B2
APPLICATION NO. : 10/766573
DATED : January 9, 2007
INVENTOR(S) : Oliphant et al.

It is certified that error appears in the above-identified patent and that said Letters Patent is hereby corrected as shown below:

Title page item 57
In the Abstract, Line 6, the word "Comer" should read --Corner--.
In the drawings, Sheet 1, Fig. 2, the reference numeral "48" adjacent reference numeral 38 should be --44--.
In the drawings, Sheet 5, Fig. 7, the reference numeral "50" should be --82--.
In Column 5, Line 13, the phrase "Channel 40" should read --Channel 70--.
In Column 6, Line 49, the phrase "panel splicing pieces 100" should read --panel splicing pieces 110--.
In Column 8, Lines 30-31, the phrase "said plurality of corner piece" should read --said plurality of corner pieces--.
In Column 11, Lines 54-55, the phrase "said plurality of corner piece" should read --said plurality of corner pieces--.
Delete title page showing an illustrative figure and substitute therefor the attached title page.
Delete sheets 1 & 5 and substitute therefor the attached sheets 1 & 5.

Signed and Sealed this

Fifteenth Day of January, 2008

JON W. DUDAS
*Director of the United States Patent and Trademark Office*

(12) United States Patent
Oliphant et al.

(10) Patent No.: US 7,159,370 B2
(45) Date of Patent: Jan. 9, 2007

(54) MODULAR FIBERGLASS REINFORCED POLYMER STRUCTURAL POLE SYSTEM

(75) Inventors: Zachary James Oliphant, Tomball, TX (US); Garett William Oliphant, Tomball, TX (US)

(73) Assignee: ReliaPOLE Solutions, Inc., Tomball, TX (US)

( * ) Notice: Subject to any disclaimer, the term of this patent is extended or adjusted under 35 U.S.C. 154(b) by 540 days.

(21) Appl. No.: 10/766,573

(22) Filed: Jan. 27, 2004

(65) Prior Publication Data

US 2005/0160697 A1 Jul. 28, 2005

(51) Int. Cl.
*E04C 3/30* (2006.01)

(52) U.S. Cl. ..... 52/731.4; 52/731.3; 52/732.3

(58) Field of Classification Search ..... 52/651.01, 52/651.07, 736.1, 726.3, 726.1, 737.6, 732.3, 52/732.2, 731.4, 731.3, 586.1, 586.2, 40; D25/126; 138/157, 162, 167; 446/111, 117, 446/122, 124

See application file for complete search history.

(56) References Cited

U.S. PATENT DOCUMENTS

| | | | | | |
|---|---|---|---|---|---|
| 466,012 | A | | 12/1891 | Seaman | |
| 999,267 | A | | 8/1911 | Slick | |
| 1,967,490 | A | * | 7/1934 | White | 405/14 |
| 2,317,634 | A | * | 4/1943 | Olsen | 52/242 |
| 3,196,990 | A | | 7/1965 | Handley | |
| 3,276,182 | A | | 10/1966 | Handley | |
| 3,291,437 | A | | 12/1966 | Bowden et al. | |
| 3,557,422 | A | | 1/1971 | Pfaff, Jr. | |
| 3,571,991 | A | | 3/1971 | Doocy et al. | |
| 3,893,269 | A | * | 7/1975 | Nelsson et al. | 52/65 |
| 4,216,895 | A | * | 8/1980 | Holmes | 228/178 |
| 4,312,162 | A | | 1/1982 | Medney | |
| 4,689,930 | A | * | 9/1987 | Menchetti | 52/277 |
| 5,285,613 | A | | 2/1994 | Goldsworthy et al. | |
| 5,319,901 | A | | 6/1994 | Goldsworthy et al. | |
| 5,617,692 | A | | 4/1997 | Johnson et al. | |
| 5,644,888 | A | | 7/1997 | Johnson | |
| 5,864,998 | A | | 2/1999 | Loomer | |
| 6,032,432 | A | * | 3/2000 | Patti | 52/732.1 |
| 6,094,881 | A | | 8/2000 | Lockwood | |
| 6,286,281 | B1 | | 9/2001 | Johnson | |

* cited by examiner

*Primary Examiner*—Naoko Slack
*Assistant Examiner*—Jessica Laux
(74) *Attorney, Agent, or Firm*—Crain, Caton & James, P.C.; James E. Hudson, III

(57) ABSTRACT

This invention is a modular pole assembly comprised of corner pieces and panel members. Panel members are slidably engaged to the corner pieces and are retained in a direction normal to the engagement direction by a track in each slot that nests within a groove in each panel member. Corner pieces may include multiple slots along each side, allowing for multiple layers of panel members along each side, thereby increasing strength and allowing an insulative and structural fill material to be added between panel member layers. The height of the modular pole may be increased by inserting splicing posts between consecutive, adjacent corner members and inserting splicing pieces between co-planar adjacent panel members. The modular nature of the pole assembly provides for simple packaging and shipment of the various components and easy assembly at or near the installation location.

20 Claims, 7 Drawing Sheets

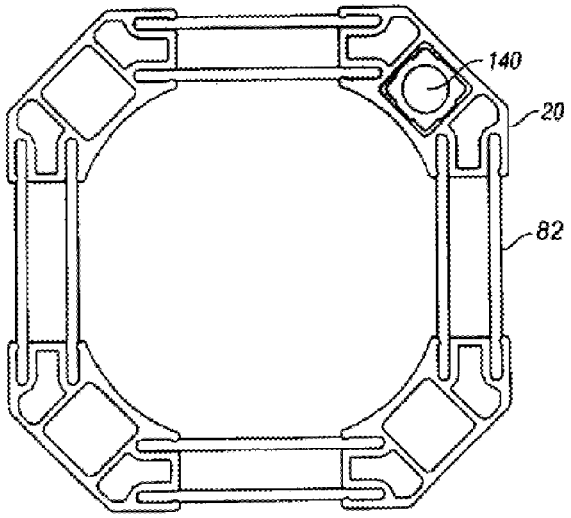

1/7

5/7